United States Patent [19]

Rilling

[11] Patent Number: 5,021,800

[45] Date of Patent: Jun. 4, 1991

[54] TWO TERMINAL ANTENNA FOR ADAPTIVE ARRAYS

[76] Inventor: Kenneth Rilling, 1190 Crestline Dr., Cupertino, Calif. 95014

[21] Appl. No.: 462,862

[22] Filed: Jan. 5, 1990

Related U.S. Application Data

[63] Continuation-in-part of Ser. No. 175,938, Mar. 31, 1988, abandoned.

[51] Int. Cl.[5] ..... H01Q 9/16

[52] U.S. Cl. ..... 343/820; 343/822; 343/850; 343/792.5; 342/372

[58] Field of Search ..... 343/820, 822, 844, 850, 343/852, 855, 860, 806, 793, 795, 803, 805, 792.5, 865, 859; 342/372, 371

[56] References Cited

U.S. PATENT DOCUMENTS

| | | | |
|---|---|---|---|
| 2,298,449 | 10/1942 | Bailey | 343/795 |
| 2,464,276 | 3/1949 | Varian | 342/371 |
| 2,613,349 | 10/1952 | Kandoian | 343/844 |
| 3,396,398 | 8/1968 | Dunlavy | 343/844 |
| 3,789,412 | 1/1974 | Keenan et al. | 343/820 |
| 4,072,956 | 2/1978 | Provencher | 343/844 |
| 4,237,464 | 12/1980 | Rittenbach | 342/371 |
| 4,309,769 | 11/1982 | Taylor, Jr. | 342/372 |
| 4,737,793 | 4/1988 | Munson et al. | 343/700 MS |

OTHER PUBLICATIONS

Bernard Widrow, Proceedings of the IEEE, vol. 55, No. 12, Dec. 1967, p. 2143.

*Primary Examiner*—Michael C. Wimer
*Assistant Examiner*—Hoanganh Le
*Attorney, Agent, or Firm*—Allston L. Jones

[57] ABSTRACT

A single two terminal antenna, such as a dipole antenna, is used to supply the input signals for a two element adaptive array. This reduces the number of antennas required by the adaptive array to reject an inteference signal from two to one. The antenna is connected so that the phase information reflecting the direction of arrival of a received signal is preserved. The resulting single antenna adaptive array functions like a two element adaptive array. When the two terminal antenna is not located at the adaptive array, two transmission lines are required to carry the output signals of the antenna. In a similar manner, an N input adaptive array (where N is an even number) can use N/2 two terminal antennas to reject N−1 interference signals.

30 Claims, 11 Drawing Sheets

PRIOR ART

TWO TERMINAL ANTENNA FOR ADAPTIVE ARRAYS

This is a continuation-in-part of copending application Ser. No. 07/175,938 filed on Mar. 31, 1988, now abandoned.

BACKGROUND

Interference can degrade the performance of communication systems. The interference signal can be a signal source unrelated to the communications system, such as the signal from another transmitter or it can be multipath. Multipath occurs when the transmitted signal of interest arrives at the receiver simultaneously from more than one direction due to reflections from buildings, hills, etc. An adaptive array is a good means of rejecting interference signals.

An adaptive array with N antenna elements can reject N−1 interference signals. There is cost, space and esthetic advantages to be able to reduce by a factor of 2 the number of antennas that an adaptive array requires to reject interference signals. The space and esthetic advantages are particularly true when a single antenna replaces the two conventional antennas of a two input adaptive array.

Adaptive array theory can be found in Bernard Widrow, Proceedings of the IEEE, Vol.55, No.12, December 1967, p.2143; Robert A. Monzingo and Thomas W. Miller, *Introduction to Adaptive Arrays*, John Wiley & Sons, New York, 1980; and Bernard Widrow and Samuel D. Stearns, *Adaptive Signal Processing*, Prentice-Hall, 1985.

The antenna elements can be omni-directional or of other antenna types. Theory for the different antenna types can be found in texts such as Kai Fong Lee, *Pronciples of Antenna Theory*, John Wiley & Sons, New York, 1984: Ronald W.P. King, *The Theory of Linear Antennas*, Harvard University Press, Cambridge, MA, 1956; and Thomas Milligan, *Modern Antenna Design*, McGraw-Hill Book Company, New York, 1985.

The type antenna used in an application is generally dictated by the application requirements: desired antenna pattern, gain, cost, space, esthetics, convenience, convention, etc. For example, the rabbit ears antenna used in TV receivers, which is a form of dipole antenna, is simple, inexpensive, portable, space saving, directional, and less esthetically objectionable than most other types of indoor antennas. Like other applications, it does not use direction of arrival information; the rabbit ears is generally connected to the TV in a manner that does not preserve the direction of arrival information, via a single transmission line. Theoretically, the rabbit ears and the center fed dipole antenna are viewed as an extension of a single transmission line.

In the adaptive array, which requires direction of arrival information, the type of antennas that are used is determined by the application. For example, in rejecting multiple jamming signals in a military communications receiver, a rabbit ears/dipole antenna is not appropriate. Although the dipole and other two terminal antennas have been used with adaptive arrays, they have been used as single antenna elements as part of arrays. Used in this conventional manner, the adaptive array requires N two terminal antennas, each acting as a single element, to reject N−1 interference signals.

In conventional transmission line theory, such as presented by Pierre Grivet, *The Physics of Transmission Lines at High and Very High Frequencies*, 1970, *Academic Press*, and Bharathi Bhat, *Analysis, Design, and Application of Transmission Lines*, 1987, Artech House, Norwood, MA., a single transmission line is connected to the dipole or two terminal antenna. But this is adequate only when the diphole or two terminal antenna is used as a single element and the complete signal from the antenna is not required.

SUMMARY OF INVENTION

In this invention a single two terminal antenna, such as a dipole antenna, is used to supply the input signals for a two element adaptive array. This reduces the number of antennas required by the adaptive array to reject an interference signal from two to one. The antenna is connected so that the phase information reflecting the direction of arrival of a received signal is preserved. The resulting single antenna adaptive array functions like a two element adaptive array.

When the two terminal antenna is not located at the adaptive array, two transmission lines are required to carry the output signals of the single antenna.

In a similar manner, an N input adaptive array (where N is an even number) can use N/2 two terminal antennas. This adaptive array can reject N−1 unwanted signals.

DETAILED DESCRIPTION OF THE PREFERRED EMBODIMENT

DIPOLE ANTENNA

In this section, the phase relationship of a two element monopole antenna array is derived, the phase relationships of the dipole antenna output signals is derived, and the form of the output signals of the two element monopole antenna array and the dipole antenna are compared. It shows that the dipole antenna, with proper signal processing, can provide an adaptive array with the necessary signal components to make it look like two antennas. As a result, in this invention, a single dipole antenna can replace the two conventional antennas that the adaptive arrays previously required to reject an interference signal.

Figure 1:
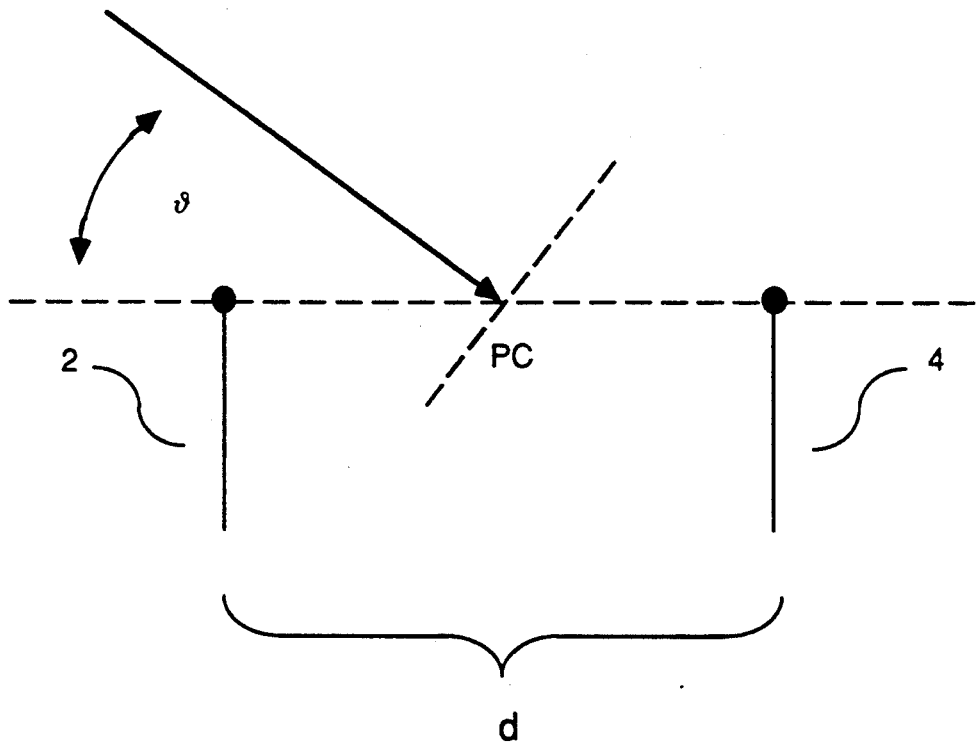
PRIOR ART FIGURE 1
FIG. 1 is a circuit diagram of two monopole antennas: prior art.

The adaptive array exploits the fact that the incident radiation arrives at the antenna array elements with different phases. Consider the case of two monopole antennas as shown in FIG. 1. The distance between the antenna 2 and 4 is "d". The signals at antennas 2 and 4 relative to the array phase center are respectively, $$S1 = A\sin(wt+\phi) \quad (1)$$

and $$S2 = A\sin(wt-\phi) \quad (2)$$

where $$\phi = (wd/c)\cos(\theta)$$

A is a constant, w is the angular frequency, t is the time, c is the speed of light, and $\theta$ is the angle of arrival. It can be seen from equations (1) and (2) that the radio wave will arrive at antenna 2 with a different phase than at antenna 4, the values of which depend on the direction of arrival. At antenna 2 the phase leads by $\phi$ and at antenna 4 it lags by $\phi$. This is expected from the physical geometry.

Figure 2:
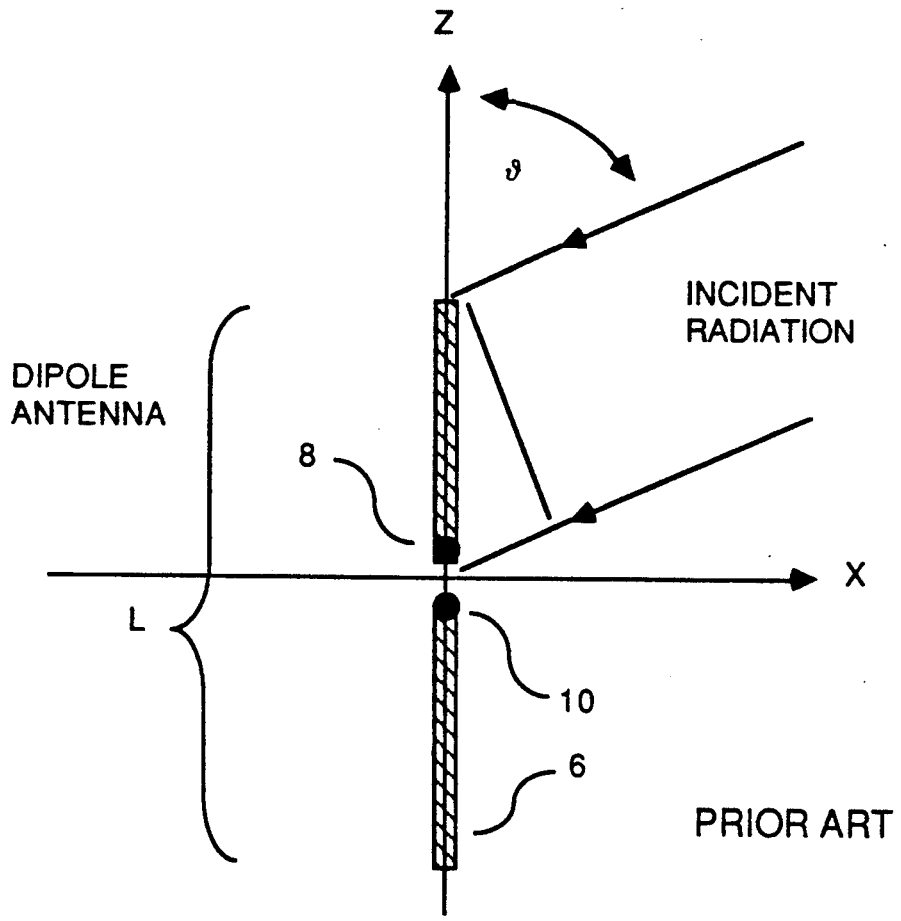
FIG. 2 shows the geometry of incident radiation for a dipole antenna: prior art.

FIG. 2 shows dipole antenna 6 and the geometry of an incident electric field. The incident radiation relative the phase center is $$E_z = E_o\sin\exp[j(wt+Kz\cos\theta)] \quad (3)$$

where "z" is the z-coordinate and K=w/c. Since, by Maxwell's Equations, the tangential component of the electric field at the antenna must be zero, a counter electric field must be set up within the antenna, $$E\,|| = -E_z. \quad (4)$$

The voltage induced in a small part of the antenna is then $$V = E\,||\,dz - -E_o\sin\theta\exp[j(wt+Kz\cos\theta)]dz. \quad (5)$$

Now consider a situation where the same antenna is used as a transmitting antenna with an applied voltage "V" and an antenna current distribution I(z). The Reciprocity Theorem states that the receiving antenna pattern and the transmitting antenna pattern of an antenna must be the same. One result of this theorem is that the ratio of the voltage applied to the terminals of the antenna used as a transmitting antenna and the current it induces in the antenna in an element dz at z is equal to the ratio of the voltage induced at an element dz and the resulting incremental current, dI, at the antenna terminals when used to receive. That is $$V_{tran}/I_{tran} = V_{rec}/I_{rec}. \quad (6)$$

Using equation (5), gives $$V_{rec}/I_{rec} = -E_o\sin\theta\exp[j(wt+kz\cos\theta)]dz/dI. \quad (7)$$

Assuming the sinusoid approximation for the antenna current distribution, $$I_{trans} = I_o\sin[K(L/2-|z|)] \quad (8)$$

where $I_o$ is a constant and L is the dipole length. Assuming that L is a half wavelength, substituting equations (7) and (8) into equation (6) and integrating over the two halves of the dipole gives the output signals at terminals 8 and 10 respectively $$D1 = B\sin(wt+\alpha) \quad (9)$$

and $$D2 = -B\sin(wt-\alpha) \quad (10)$$

where $$\alpha = \mathrm{Tan}^{-1}\{\cos(\pi/2\cos\theta)/[\cos\theta-\sin(\pi/2\cos\theta)]\}$$

and $$B = B(\theta).$$

The phase $\alpha$ depends on the direction of arrival. Comparing equations (9) and (10) to equations (1) and (2), it is seen that they have the same form except for the negative factor in equation (10).

Figure 3:
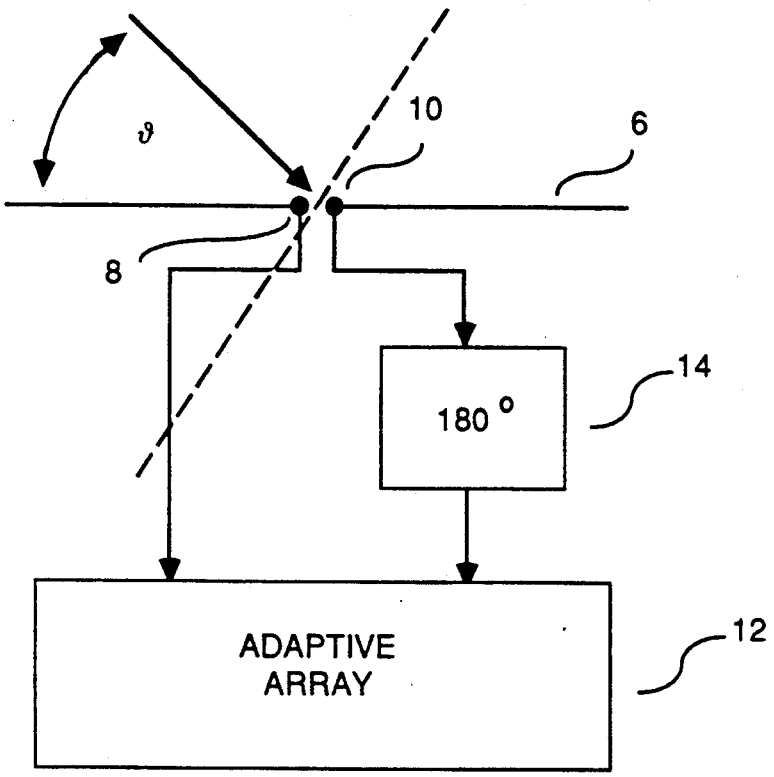
FIG. 3 is of a circuit diagram of a dipole antenna connected to an adaptive array.

FIG. 3 shows dipole antenna 6, the output signals of which are at the terminal 8 and terminal 10. By connecting terminal 10 to the input terminal of 180 degree phase shifter 14, the output signal of 180 degree phase shifter 14 is $$D2 = B\sin(wt-\alpha) \quad (11)$$

Now equations (9) and (11) have the same form as equations (1) and (2). This means that a single dipole antenna can be used as a two element array for an adaptive array just like the two monopole antennas.

In FIG. 3, connecting terminal 8 and the output terminal of 180 degree phase shifter 14, respectively, to the input terminals of adaptive array 12, provides adaptive array 12 with all required signal components to reject an interfering signal. The requirement for an adaptive array to have at least two antenna elements to reject one interfering signal is changed to having a single dipole antenna. This provides cost savings, space savings, and esthetic improvements. This is one form of the present invention.

Figure 4:
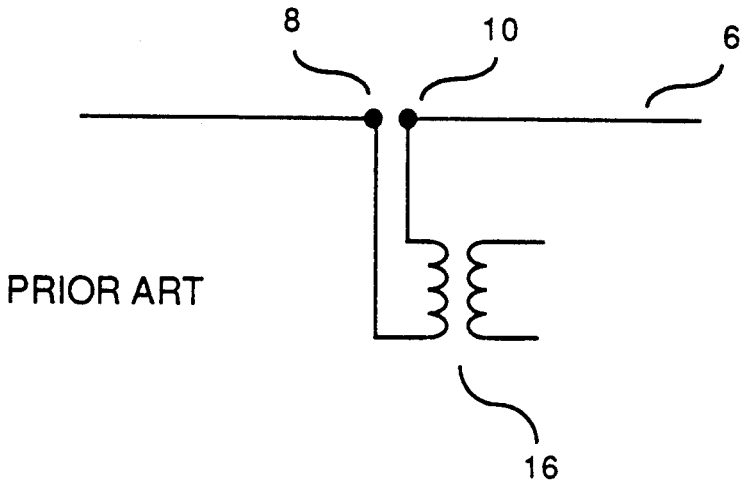
FIG. 4 is a circuit diagram of a diphole antenna connected in a conventional manner: prior art.

This contrasts with the conventional methods of connecting a dipole antenna. FIG. 4 shows a conventional connection of dipole antenna 6. The output signals from terminals 8 and 10 of dipole antenna 6 are connected to transformer 16. This puts terminals 8 and 10 in series and their output signals are effectively summed. To determine the effects of the summing, equations (9) and (10) can be written, respectively, $$D1 = B\cos(\alpha)\sin(wt) + B\sin(\alpha)\cos(wt) \quad (12)$$

$$D2 = -B\cos(\alpha)\sin(wt) + B\sin(\cos(wt). \quad (13)$$

Summing equations (12) and (13) gives $$S = 2B\sin(\alpha)\cos(wt). \quad (14)$$

The phase in equation (14) no longer depends on the direction of arrival. The direction of arrival related phase information has been lost by the conventional connection of dipole antenna 6. When connected in the conventional manner, two physically separated dipole antennas are needed to supply the required signal components in order that the adaptive array can reject one interference signal.

In the case of an adaptive array with N input terminals (N being an even number), N/2 dipole antennas, each dipole having an 180 phase shift in a respective terminal, can be connected to the N input terminals. The adaptive array will be able to reject N−1 interference signals, just like a conventional N input terminal adaptive array that uses N antennas. This is another form of the present invention.

In many adaptive array implementations, the appropriate phase relationship between antenna input signals can be critical to the stability of the adaptive array. The appropriate phase relationship requirement between signals gave rise to the phase shift requirement.

In some adaptive arrays, stability does not depend as strongly on or is transparent to the phase relationship between antenna input signals. Such a phase-stable adaptive array can occur as a result of the specific adaptive array, the type of antenna, the application, etc. The phase shift requirement of the two terminal antenna output signal is no longer true for the phase-stable adaptive array.

Figure 10:
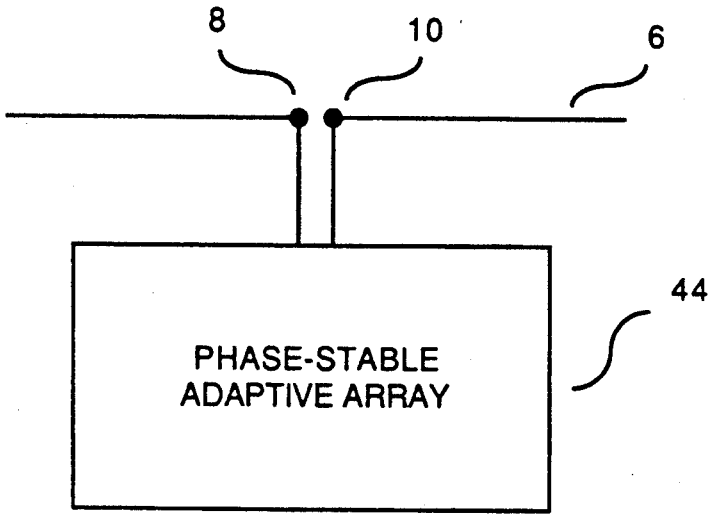
FIG. 10 is a circuit diagram of a dipole antenna and a phase-stable adaptive array.

FIG. 10 shows a phase-stable adaptive array. Output terminals 8 and 10 of dipole antenna 6 are connected to the input terminals of phase-stable adaptive array 44, where the phase-stable adaptive array 44 can be a constant modulus algorithm type adaptive array (as defined in U.S. Pat. No. 4,736,460) used for an FM signal in multipath interference.

Figure 7:
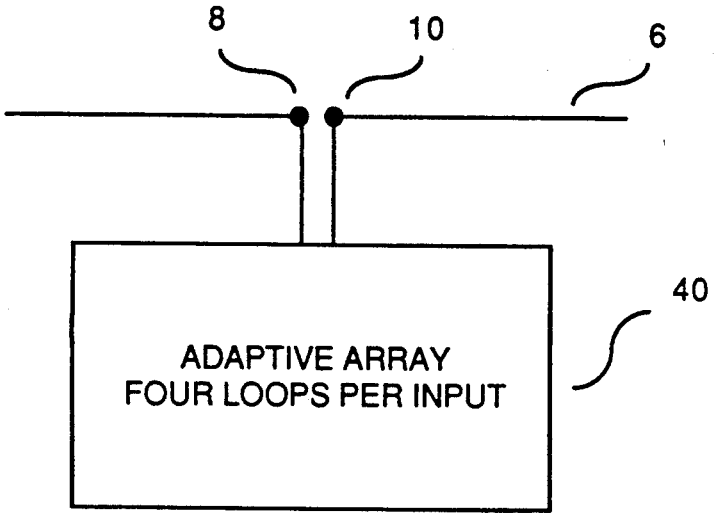
FIG. 7 is a circuit diagram of a four loop per input adaptive array.

The adaptive array can be designed to be transparent to the unique value of the phase relationship between the input signals for a particular antenna. FIG. 7 shows a case where each adaptive array 12 input has four adaptive loops having time delays/phases of 0, 90, 180, and 270 degrees, making 180 degree phase shifter 14 unnecessary. A 180 degree phase shift causes the delays/phases of each the to be 180, 270, 360, and 450 degrees respectively. This is equivalent to 180, 270, 0, and 90 dgrees respectively. The net result is unchanged, making the 180 degree phase shifter 14 unnecessary. This is a phase-stable adaptive array.

In FIG. 7, the output signal of terminals 8 and 10 of dipole 6 are connected to the inputs of the four loops per input adaptive array 40. The time delays/phases of the four loops of each input of adaptive array 40 are 0, 90, 180, and 270 degrees. Phase-stable adaptive arrays are another form of the invention.

TWO TERMINAL ANTENNA

As in the case of the dipole antenna, physically separated parts of an antenna will have voltages of different phases induced due to geometry. When there are at least two parts (i.e. elements) to an antenna which are separated physically, and two wires are connected to two output terminals to deliver the induced signal, the antenna is a two terminal antenna. In the two terminal antenna of interest in this invention, the antenna is made up of two or more parts, each of which are physically separated from one another and have voltages of different phases induced in them. These voltage phases depend on the direction of arrival of the radiowave.

Any two terminal antenna with output signals, the phases of which depend on the direction of arrival of the radiowave, can be used to provide two input signals to an adaptive array. Two terminal antennas include but are not limited to dipole, folded dipole, loop, bow, Yagi, and log periodic antennas. Many two terminal antennas are combinations of various forms of these simpler two terminal antennas, such as the Yagi/log-periodic antenna, and are used in applications such as broadcast television and FM receiving Yagi and log periodic antennas are two terminal antennas made up of planar arrays of cylindrical dipoles elements (As defined in Arrays of Cylindrical Dioples by Ronold W.P. King, Richard B. Mack and Sheldon S. Sandler, Cambridge at The University Press, 1968). Other two terminal antennas can be formed by other combinations of dipole elements consisting of dipole means and folded dipole means in arrays, where the elements can be of different lengths, fed or parasitic, loaded or unloaded, etc. The rabbit ears antenna is viewed as a form of the dipole antenna for the purposes of this invention. Two terminal antennas also include the slot equivalent of these antennas. Subarrays can also be used as two terminal antennas. The phase shift required in one of the output terminals is not necessarily 180 degrees in all these two terminal antennas. This is another form of the invention.

Figure 8:
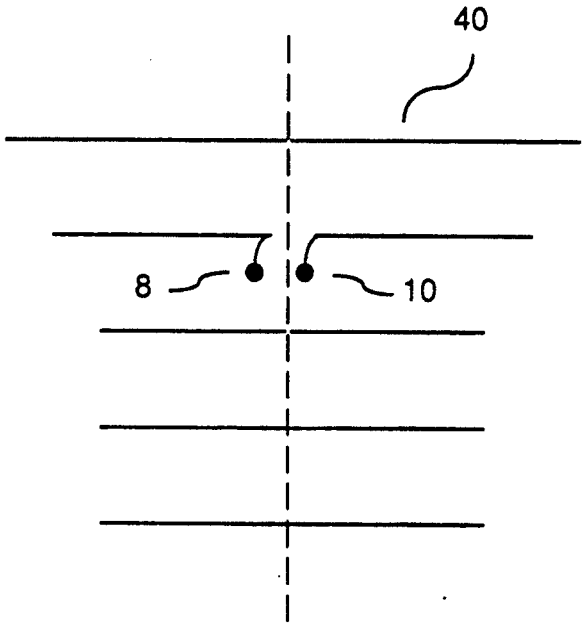
PRIOR ART FIGURE 8
FIG. 8 shows a five element broadband Yagi antenna of the prior art.

FIG. 8 shows a five element, broadband, Yagi (Uda-Yagi) antenna 40 of the form used for TV reception. This antenna is a two terminal antenna, where terminals 8 and 10 provide two signals when connected to an adaptive array. The antenna shown in FIG. 8 is only one form of the Yagi antenna, and the present invention is not restricted to only this form of the Yagi antenna.

Figure 9:
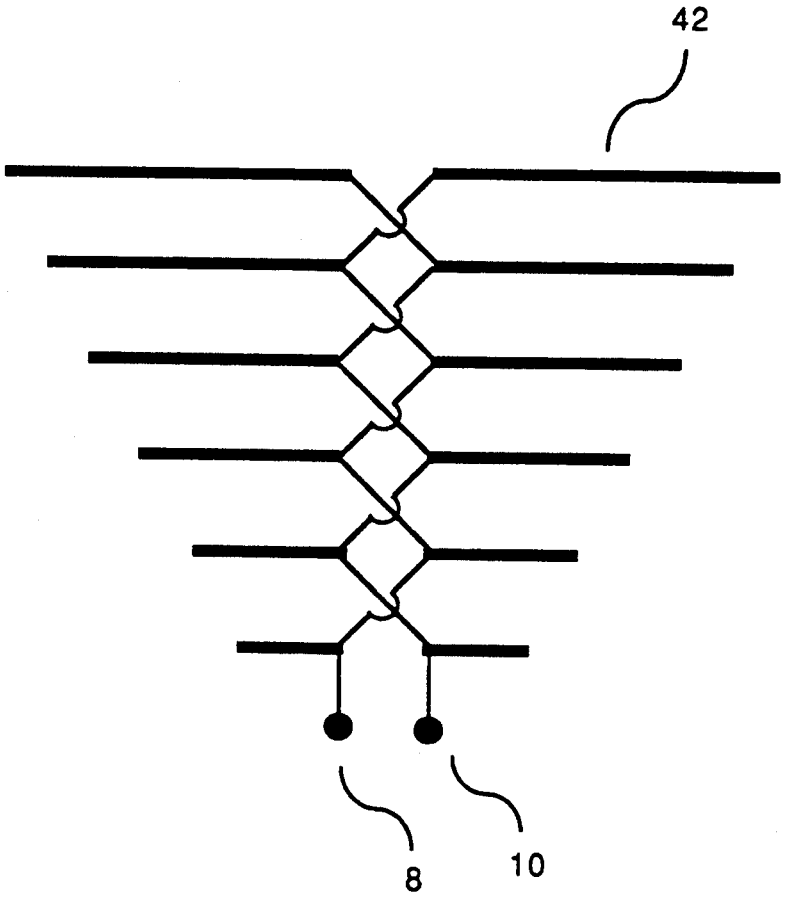
PRIOR ART FIGURE 9
FIG. 9 shows a dipole log-periodic antenna of the prior art.

FIG. 9 shows a long-periodic antenna 42 which is a dipole form of log-periodic with terminals 8 and 10 as the output terminals. The log-period antenna is a two terminal antenna, where terminals 8 and 10 provide two signals when connected to an adaptive array. The form shown in this figure is a popular form of log-periodic antenna used for commercial TV reception. There are numerous other forms of log-periodic antennas, and the present invention is not restricted to only this form of the log-periodic antenna.

TRANSMISSION LINE

If an adaptive array is not located right at the antenna terminals, and the electrical distance is long, transmission lines are necessary to carry the antenna output signals to the adaptive array. In a conventional connection of a two terminal antenna, a single transmission line is used to carry the antenna's output signals.

Figure 5:
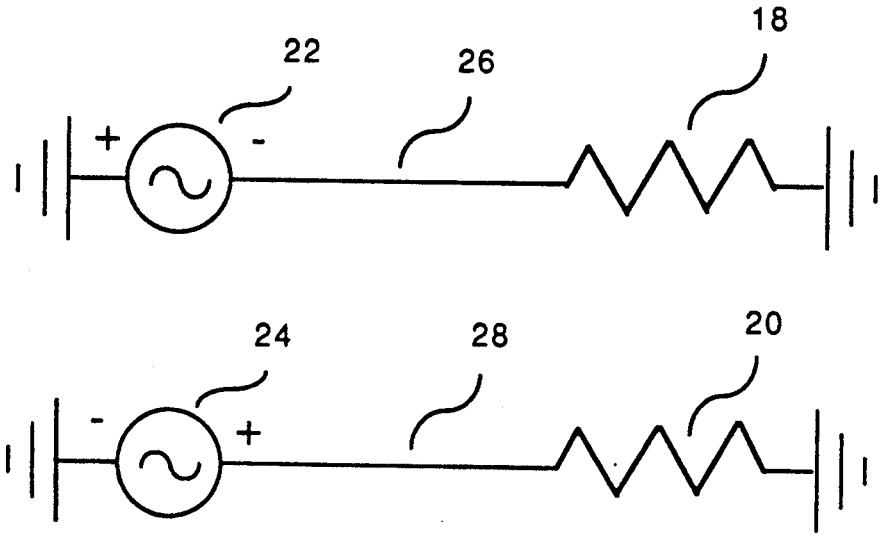
FIG. 5 is a circuit diagram of the electrical equivalent of a transmission line: prior art.

FIG. 5 shows the electrical equivalent of a transmission line with a signal source and a load. It consists of source 22, the output signal of which is connected to path 26. The output signal of the path 26 goes to load 18. It also contains source 24, the output signal of which is connected to path 28. The output signal of path 28 is connected to load 20. For the transmission line to operate in the transmission mode, the electrical equivalent signal sources must have opposite signs. Using this interpretation, the first term in equations (12) and (13) fulfill this requirement; they have the opposite signs. That part of the signal will propagate down the transmission line in the transmission mode. But the second term in equation (12) and (13) do not. The second terms act as if path 26 and path 28 are electrically the same point. So they propagate in the conduction mode.

The conduction mode and the transmission mode have different propagation velocities through the transmission line. Including the transmission line path in equations (11) and (12) gives $$S_T = B\cos(\alpha)\sin(wt - wg/v_1) + B\sin(\alpha)\cos(wt - wg/v_2) \quad (15)$$

$$S_B = -B\cos(\alpha)\sin(wt - wg/v_1) + B\sin(\alpha)\cos(wt - wg/v_2) \quad (16)$$

The phase in equations (15) and (16) contain terms $wg/v_1$ and $wg/v_2$, where g is the distance traveled through the transmission line, $v_2$ is the velocity of propagation of the conduction mode and $v_1$ is the velocity of propagation in the transmission mode. Due to the different propagation velocities in the first and second terms in equations (15) and (16), in a long transmission line, the signals arrive at the output with the wrong relative electrical phase. The transmission line connected in this manner would provide the adaptive array signals with the incorrect phase information.

Figure 6A:
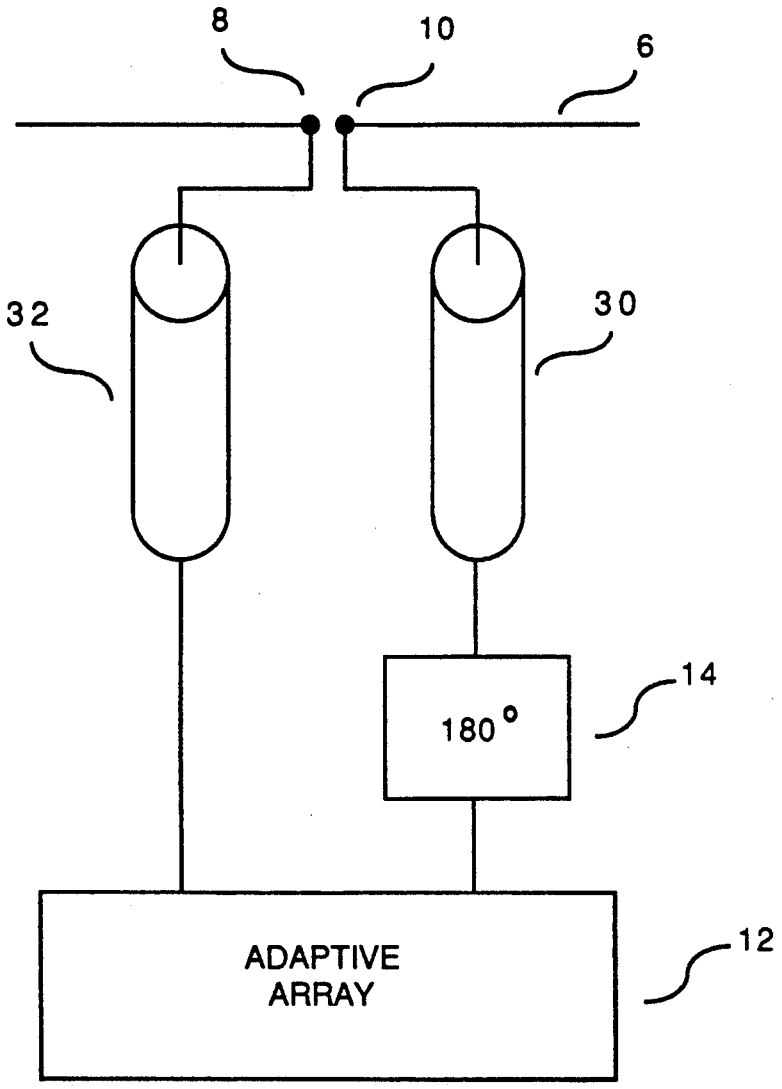
FIG. 6A is a circuit diagram of the dipole antenna and transmission line connected to the adaptive array.

To correct this problem, each terminal from the dipole antenna or two terminal antenna must be connected to a separate transmission line as is shown in FIG. 6A. The output signal of terminal 8 of dipole antenna 6 is connected to transmission line 32. The output signal of transmission line 32 is connected to an input terminal of adaptive array 12. Similarly, the output signal of terminal 10 goes to transmission line 30. The output signal of transmission line 30 goes to 180 phase shifter 14. The output signal of 180 degree phase shifter 14 goes to an input of adaptive array 12. The 180 degree phase shifter 14 can be located either before or after the transmission line. In this way the correct and complete signal from the two terminal antenna is sent to the adaptive array when the antenna is a long distance form the adaptive array. This is another form of the present invention.

IMPEDANCE MATCHING

To optimize the antenna performance, an impedance matching means can be placed between the antenna terminal and the transmission line, antenna terminal and the adaptive array input terminal, and the antenna terminal and the 180 degree phase shifter 14.

Figure 6B:
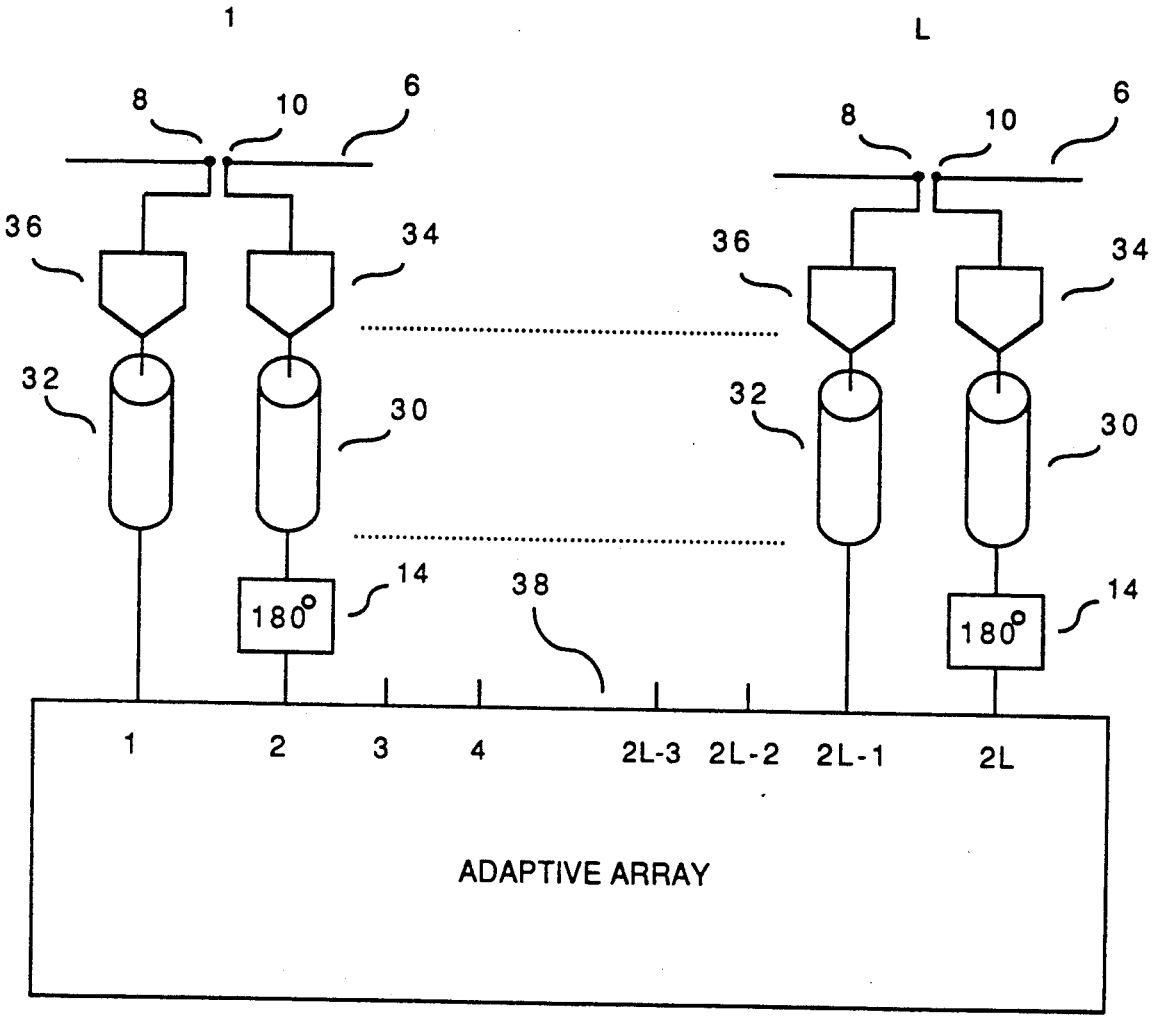
FIG. 6B is a circuit diagram of a 2L input adaptive array with L dipole antennas.

FIG. 6B shows an 2L input adaptive array with L dipole antennas. The output signal of terminal 8 of dipole antenna 6 is connected to the input impedance matching means 36. The output signal of impedance matching means 36 is connected to transmission line 32. The output signal of transmission line 32 is connected to an input terminal of the adaptive array 38. Similarly, the output signal of terminal 10 goes to input of impedance matching means 34. The output signal of impedance matching means 34 is connected to transmission line 30. The output signal of transmission line 30 goes to the input of 180 degree phase shifter 14. The output signal of 180 degree phase shifter 14 goes to an input of adaptive array 38. The 180 degree phase shifter 14 can be located either before or after the transmission line. This is another form of the invention.

It would be clear to one skilled in the art that the invention can be implemented for an adaptive array that is an analog, digital, analog/digital hybrid, software/-digital hybrid or analog/software hybrid form.

From the forgoing description, it will be apparent that the invention disclosed herein provides novel and advantageous antenna systems for adaptive arrays. It will be understood by those familiar with the art, the invention may be embodied in other specific forms without departing from the spirit or essential characteristics thereof.

What is claimed:

1. An antenna system for reducing by one half the number of antennas required by an adaptive array means to reject interference signals, said system comprising:

at least one antenna array means which includes at least two dipole element means; and phase shifter means coupled to recieve the output signal of the first terminal of the antenna array means for changing the phase of the output signal;

where the output terminal of the phase shifter means and the second terminal of the antenna array means are each disposed to be coupled to different input terminals of the adaptive array such that direction of arrival phase information is retained;

the said adaptive array means having a number of input terminal pairs that correspond to the number of antenna array means.

2. An antenna system as in claim 1 also including first impedance matching means coupled to the first terminal of the antenna array means for matching the impedance at the phase shifter means input terminal and a second impedance matching means coupled to the second terminal of the antenna array means for matching the impedance at the adaptive array means input terminal.

3. An antenna system as in claim 2 also including first transmission line means coupled to the output terminal of the first impedance matching means and the input terminal of the phase shifter means and a second transmission line means coupled to the output terminal of the second impedance matching means and the input terminal of the adaptive array means for transmitting the output signals of the impedance matching means.

4. An antenna system as in claim 1 also including first transmission line means coupled to the first terminal of the antenna array means and the input terminal of the phase shifter means and a second transmission line means coupled to the second terminal of the antenna array means and an input terminal of the adaptive array means for transmitting the output signals of the antenna array means.

5. An antenna system for reducing by one half the number of antennas required by an adaptive array means to reject interference signals, said system comprising:

at least one dipole antenna means; and 180 degree phase shifter means coupled to receive the output signal of the first terminal of the dipole antenna means for changing the sign of the output signal;

where the output terminal of the 180 degree phase shifter means and the second terminal of the dipole antenna means are each disposed to be coupled to different input terminals of the adaptive array means such that direction of arrival phase information is retained;

the said adaptive array means having a number of input terminal pairs that correspond to the number of dipole antenna means.

6. An antenna system as in claim 5 also including first impedance matching means coupled to the first terminal of the dipole antenna means for matching the impedance at the 180 degree phase shifter means input terminal and a second impedance matching means coupled to the second terminal of the dipole antenna means for matching the impedance at the adaptive array means input terminal.

7. An antenna system as in claim 6 also including first transmission line means coupled to the output terminal of the first impedance matching means and the input terminal of the 180 degree phase shifter means and a second transmission line means coupled to the output terminal of the second impedance matching means and the input terminal of the adaptive array means for transmitting the output signals of the impedance matching means.

8. An antenna system as in claim 5 also including first transmission line means coupled to the first terminal of the dipole antenna means and the input terminal of the 180 degree phase shifter means and a second transmission line means coupled to the second terminal of the dipole antenna means and an input terminal of the adaptive array means for transmitting the output signals of the dipole antenna means.

9. An antenna system for reducing by one half the number of antennas required by an adaptive array means to reject interference signals, said system comprising:

at least one folded dipole antenna means; and phase shifter means coupled to receive the output signal of the first terminal of the folded dipole antenna means for changing the phase of the output signal;

where the output terminal of the phase shifter means and the second terminal of the folded dipole antenna means are each disposed to be coupled to different input terminals of the adaptive array means such that direction of arrival phase information is retained;

the said adaptive array means having a number of input terminal pairs that correspond to the number of folded dipole antenna means.

10. An antenna system as in claim 9 also including first impedance matching means coupled to the first terminal of the folded dipole antenna means for matching the impedance at the phase shifter means input terminal and a second impedance matching means coupled to the second terminal of the folded dipole antenna means for matching the impedance at the adaptive array means input terminal.

11. An antenna system as in claim 10 also including first transmission line means coupled to the output terminal of the first impedance matching means and the input terminal of the phase shifter means and a second transmission line means coupled to the output terminal of the second impedance matching means and the input terminal of the adaptive array means for transmitting the output signals of the impedance matching means.

12. An antenna system as in claim 9 also including first transmission line means coupled to the first terminal of the folded dipole antenna means and the input terminal of the phase shifter means and a second transmission line means coupled to the second terminal of the folded dipole antenna means and an input terminal of the adaptive array means for transmitting the output signals of the folded dipole antenna means.

13. An antenna system for reducing by one half the number of antennas required by an adaptive array means to reject interference signals, said system comprising:

at least one Yagi antenna means; and phase shifter means coupled to receive the output signal of the first terminal of the Yagi antenna means for changing the phase of the output signal;

where the output terminal of the phase shifter means and the second terminal of the Yagi antenna means are each disposed to be coupled to different input terminals of the adaptive array means such that direction of arrival phase information is retained;

the said adaptive array means having a number of input terminal pairs that correspond to the number of Yagi antenna means.

14. An antenna system as in claim 13 also including first impedance matching means coupled to the first terminal of the Yagi antenna means for matching the impedance at the phase shifter means input terminal and a second impedance matching means coupled to the second terminal of the Yagi antenna means for matching the impedance at the adaptive array means input terminal.

15. An antenna system as in claim 13 also including first transmission line means coupled to the output terminal of the first impedance matching means and the input terminal of the phase shifter means and a second transmission line means coupled to the output terminal of the second impedance matching means and the input terminal of the adaptive array means for transmitting the output signals of the impedance matching means.

16. An antenna system as in claim 13 also including first transmission line means coupled to the first terminal of the Yagi antenna means and the input terminal of the phase shifter means and a second transmission line means coupled to the second terminal of the Yagi antenna means and an input terminal of the adaptive array means for transmitting the output signals of the Yagi antenna means.

17. An antenna system for reducing by one half the number of antennas required by an adaptive array means to reject interference signals, said system comprising:

at least one log periodic antenna means; and phase shifter means coupled to receive the output signal of the first terminal of the log periodic antenna means for changing the phase of the output signal;

where the output terminal of the phase shifter means and the second terminal of the log periodic antenna means are each disposed to be coupled to different input terminals of the adaptive array means such that direction of arrival phase information is retained;

the said adaptive array means having a number of input terminal pairs that correspond to the number of log periodic antenna means.

18. An antenna system as in claim 17 also including first impedance matching means coupled to the first terminal of the log periodic antenna means for matching the impedance at the phase shifter means input terminal and a second impedance matching means coupled to the second terminal of the log periodic antenna means for matching the impedance at the adaptive array means input terminal.

19. An antenna system as in claim 18 also including first transmission line means coupled to the output terminal of the first impedance matching means and the input terminal of the phase shifter means and a second transmission line means coupled to the output terminal of the second impedance matching means and the input terminal of the adaptive array means for transmitting the output signals of the impedance matching means.

20. An antenna system as in claim 17 also including first transmission line means coupled to the first terminal of the log periodic antenna means and the input terminal of the phase shifter means and a second transmission line means coupled to the second terminal of the log periodic antenna means and an input terminal of the adaptive array means for transmitting the output signals of the log periodic antenna means.

21. An antenna system for reducing by one half the number of antennas required by an adaptive array means to reject interference signals, said system comprising:

at least one dipole antenna means;

where the output terminals of the dipole antenna means are each disposed to be coupled to different input terminals of the adaptive array means such that direction of arrival phase information is retained;

the said adaptive array means having a number of input terminal pairs that correspond to the number of dipole antenna means and having each input terminal signal processed by four loops means having time/phase delays means equivalent to 0, 90, 180, and 270 degrees respectively.

22. An antenna system as in claim 21 also including first impedance matching means coupled to the first terminal of the dipole antenna means for matching the impedance at adaptive array means input terminal and a second impedance matching means coupled to the second terminal of the dipole antenna means for matching the impedance at the adaptive array means input terminal.

23. An antenna system as in claim 22 also including first transmission line means coupled to the output terminal of the first impedance matching means and an input terminal of the adaptive array means and a second transmission line means coupled to the output terminal of the second impedance matching means and an input terminal of the adaptive array means for transmitting the output signals of the impedance matching means.

24. An antenna system as in claim 21 also including first transmission line means coupled to the first terminal of the dipole antenna means and an input terminal of the adaptive array means and a second transmission line means coupled to the second terminal of the dipole antenna means and an input terminal of the adaptive array means for transmitting the output signals of the dipole antenna means.

25. An antenna system for reducing by one half the number of antennas required by an adaptive array means to reject interference signals, said system comprising:

at least one loop antenna means; and a phase shifter means coupled to receive the output signal of the first terminal of the loop antenna means for changing the sign of the output signal;

where the output terminal of the phase shifter means and the second terminal of the loop antenna means are each disposed to be coupled to different input terminals of the adaptive array means such that direction of arrival phase information is retained;

the said adaptive array means having a number of input terminal pairs that correspond to the number of loop antenna means.

26. An antenna system for reducing by one half the number of antennas required by a phase-stable adaptive array means to reduce interference signals, said system comprising:

at least one antenna array means which includes at least two dipole element means;

where the output signals of the terminals of the antenna array means are each disposed to be coupled to different input terminals of the phase-stable adaptive array means such that direction of arrival phase information is retained;

the said phase-stable adaptive array means having a number of input terminal pairs that correspond to the number of antenna array means.

27. An antenna system for reducing by one half the number of antennas required by a phase-stable adaptive array means to reduce interference signals, said system comprising:

at least one dipole antenna means; where the output signals of the terminals of the dipole antenna means are each disposed to be coupled to different input terminals of the phase-stable adaptive array means such that direction of arrival phase information is retained;

the said phase-stable adaptive array means having a number of input terminal pairs that correspond to the number of dipole antenna means.

28. An antenna system for reducing by one half the number of antennas required by a phase-stable adaptive array means to reduce interference signals, said system comprising:

at least one folded dipole antenna means; where the output signals of the terminals of the folded dipole antenna means are each disposed to be coupled to different input terminals of the phase-stable adaptive array means such that direction of arrival phase information is retained;

the said phase-stable adaptive array means having a number of input terminal pairs that correspond to the number of folded dipole antenna means.

29. An antenna system for reducing by one half the number of antennas required by a phase-stable adaptive array means to reduce interference signals, said system comprising:

at least one Yagi antenna means;

where the output signals of the terminals of the Yagi antenna means are each disposed to be coupled to different input terminals of the phase-stable adaptive array means such that direction of arrival phase information is retained;

the said phase-stable adaptive array means having a number of input terminal pairs that correspond to the number of Yagi antenna means.

30. An antenna system for reducing by one half the number of antennas required by a phase-stable adaptive array means to reduce interference signals, said system comprising:

at least one log-periodic antenna means; where the output signals of the terminals of the log-periodic antenna means are each disposed to be coupled to different input terminals of the phase-stable adaptive array means such that direction of arrival phase information is retained;

the said phase-stable adaptive array means having a number of input terminal pairs that correspond to the number of log-periodic antenna means.

* * * * *